United States Patent [19]

Hipp

[11] 4,248,159

[45] Feb. 3, 1981

[54] PIVOTED RAILWAY HOPPER CAR DOOR LATCHING MECHANISM

[75] Inventor: James D. Hipp, Toledo, Ohio

[73] Assignee: Midland-Ross Corporation, Cleveland, Ohio

[21] Appl. No.: 75,693

[22] Filed: Sep. 14, 1979

[51] Int. Cl.[3] ..... B61D 7/16; B61D 7/22; B61D 49/00

[52] U.S. Cl. ..... 105/308 R; 105/308 B; 105/309

[58] Field of Search ..... 105/280, 308 R, 308 A, 105/308 B, 308 C, 308 F, 308 P

[56] References Cited

U.S. PATENT DOCUMENTS

| | | | |
|---|---|---|---|
| 964,283 | 7/1910 | Link | 105/308 R X |
| 1,267,834 | 5/1918 | Yost | 105/308 R X |
| 3,238,898 | 3/1966 | Floehr | 105/309 X |
| 3,240,165 | 3/1966 | Floehr | 105/309 X |
| 3,240,166 | 3/1966 | Floehr | 105/309 X |
| 4,119,041 | 10/1978 | Hipp | 105/308 R |

*Primary Examiner*—Howard Beltran
*Attorney, Agent, or Firm*—Harlan E. Hummer

[57] ABSTRACT

A latching mechanism for a railroad car hopper door. The mechanism includes, a pair of hook-like catches mounted adjacent the hopper door, a pair of latches carried by the hopper door for interlockingly engaging the catches, a pawl which engages one of the latches to prevent the latches from becoming disengaged from the catches, and a spring biased plunger for frictionally engaging the pawl to aid in the prevention of movement of the pawl out of the position where it blocks disengagement of the latches from the catches, whereby the hopper door is free to swing to an open position.

7 Claims, 4 Drawing Figures

PIVOTED RAILWAY HOPPER CAR DOOR LATCHING MECHANISM

BACKGROUND OF THE INVENTION

The invention is an improvement in a railroad car hopper door latching mechanism as disclosed, for example, in U.S. Pat. Nos. 3,238,898 or 3,240,165, each of which shows and describes the use of a pair of hook-like catches which are fixedly disposed adjacent a drop bottom hopper door. A pair of L-shaped latches having oval cams with outstanding legs are carried by the hopper door and are rotatable, in unison, into and out of interlocking engagement with the catches. A pawl is provided to contact one of the latches to prevent the latches from being accidentally rotated out of interlocking engagement with the catches. These components of the latching mechanism become worn with use and loosely engage each other, thereby enhancing the chances of their being joustled out of interlocking engagement, as the hopper cars are transported from one location to another, so that the hopper doors can accidentally drop open. The invention is directed to the provision of a safety mechanism for further insuring that the latching mechanism stays in a locked position.

Briefly stated, the invention is in a latching mechanism for a railroad car hopper door. The mechanism comprises a pair of hook-like catches which are fixedly secured adjacent the lateral marginal edges of the hopper door. A pair of latches are carried by the hopper door for interlocking engagement with the catches. A pawl, also carried by the hopper door, is rotatable into and out of interlocking engagement with one of the latches to maintain the pair of latches interlocked with the pair of catches. A spring biased plunger is provided to frictionally engage the pawl and aid in the prevention of disengagement of the pawl and latch.

DESCRIPTION OF THE DRAWING

The following description will be better understood by having reference to the accompanying drawing, wherein:

FIG. 3 is an enlarged side view of the locking pawl and spring biased plunger; and FIG. 4 is a section viewed from the line 4—4 of FIG. 3.

ENVIRONMENT OF THE INVENTION

Figure 2:
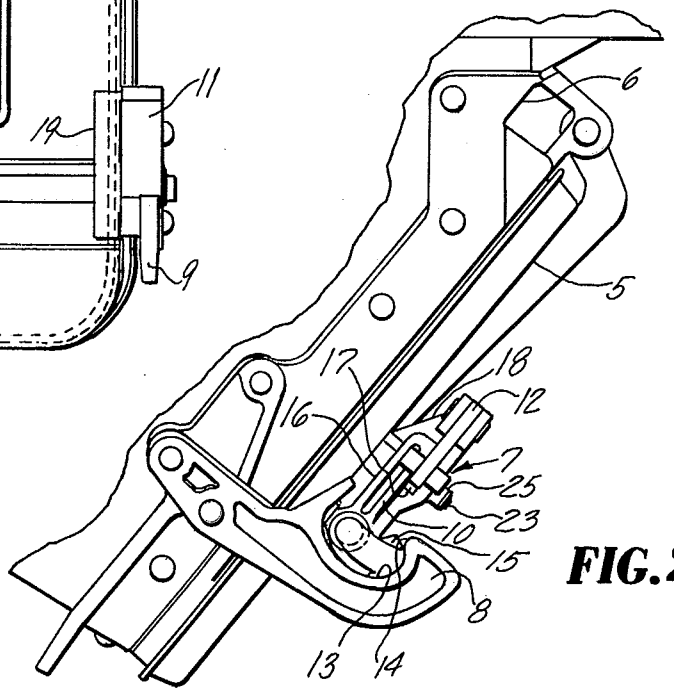
FIG. 2 is a side view of the hopper door and latching mechanism.
Figure 1:
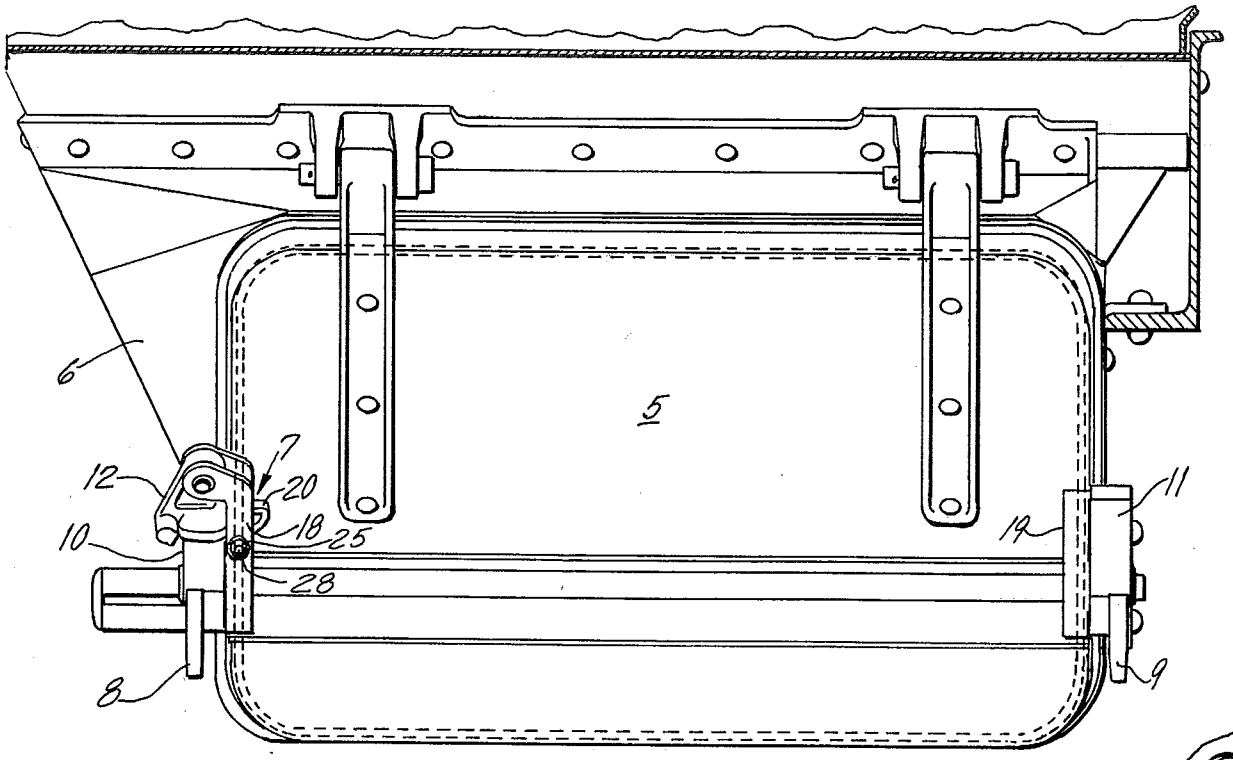
FIG. 1 is a front elevation view of a hopper door and latching mechanism made in accordance with the invention.

With reference to the drawing, there is shown a drop bottom, hopper door 5 which is hinged at the top to a frame 6 that is secured to an opening in the bottom of a railway hopper car.

A latching mechanism 7 is provided to secure the hopper door 5 in a closed position adjacent the frame 6. The latching mechanism 7 essentially comprises a pair of catches 8,9; a pair of latches 10,11 for interlocking engagement with the catches 8,9; and a pawl 12 for preventing disengagement of the latches 10, 11 from the catches 8,9.

The catches 8,9 are secured to the hopper door frame 6 adjacent either side of the hopper door 5. The catches 8,9 each have a hook-like configuration with a specially configured socket or recess 13 formed in the upper marginal edge 14 thereof.

The latches 10,11 are each L shaped and include a generally oval-shaped cam 15 with an outstanding attached leg 16. The latches 10,11 are mounted on a pair of brackets 18,19 that are secured in parallel relation on the hopper door 5 adjacent the catches 8,9. The latches 10,11 are conventionally mounted for unitary rotation about an axis which is parallel to the plane of the hopper door 5. The catches 8,9 and latches 10,11 are locked together and unlocked from each other by rotating the cams 15 of the latches 10,11 into and out of the recesses 13 of the catches 8,9.

The pawl 12 is mounted on one of the brackets 18 for rotation into and out of blocking relation with the rotation of the leg 16 of an adjacent latch 10 to prevent the latches 10,11 from accidentally becoming disengaged from the catches 8,9, whereby the hopper door 5 is free to swing or drop open. The pawl 12 has a configured tip portion 20 which is rotatable into and out of an opening 17 in the bracket 18. The tip portion 20 of the pawl is provided with a curved surface 21 which is formed on a single radius from the rotational axis of the pawl 12.

In operation, the hopper door 5 is closed by swinging it against the hopper door frame 6 and rotating the latches 10,11 into interlocking relation with the catches 8,9, i.e. to positions where the cams 15 are in the recesses 13 and the legs 16 are in upright positions where they are adjacent and generally parallel to the plane of the hopper door 5. The pawl 12 is in an open position where the tip portion 20 is in farthest spaced relation from the bracket 18 to permit rotation of the legs 16 towards the hopper door 5. The pawl 12 is then rotated to a closed position where the tip portion 20 is between the bracket 18 and the upright leg 16 of the adjacent latch 10 to block rotation of the leg 16 in a direction away from the hopper door 5.

THE INVENTION

The curved surface 21 of the pawl 12 is provided with a curved indentation 22 which is aligned with the adjacent bracket 18 on which the pawl 12 is mounted, when the pawl 12 is in a closed position as previously described.

A spring biased plunger or pin 23, as best seen in FIGS. 3 and 4, is mounted on the bracket 18 by any suitable means 24 for receipt in the curved indentation 22 of the pawl 21, when the pawl 21 is in a closed position, to further prevent the pawl 12 from accidentally rotating out of blocking engagement with the adjacent latch 10.

The plunger mounting means 24, in this instance, essentially comprises an upstanding cylindrical collar 25 with a center bore 26 that is longitudinally aligned with the curved indentation 22. The collar 25 is formed in the bracket 18 and has an annular abutment 27 which extends into the bore 26 in spaced relation from the rotational plane of the pawl 12.

The plunger 23 fits in the center bore 26 and, as best seen in FIG. 4, comprises a solid cylindrical shank 28 having a pair of opposing ends 29,30. A washer 31 is secured to the outer end 30 of the plunger 23 protruding from the abutment 27 and collar 25, to restrict axial movement of the plunger 23 in the direction of the pawl 12. The other end 29 of the plunger 23 within the center bore 26, has an enlarged head 32 with a conically shaped tip 33 that is rounded and extends from the center bore 26 into the curved indentation 22 and plane in which the pawl 12 rotates. A helical metal spring 34 surrounds the shank 28 of the plunger 23 between the annular abutment 27 of the collar 25 and the enlarged head 32 of the plunger 23 to bias the plunger 23 in the direction of the pawl 12 and rotational plane thereof. It can be appreciated that the plunger 23 is designed to frictionally engage the pawl 12 which can be forced to override the spring biased plunger 23 as the pawl 12 is rotated to and from a position, where the curved indentation 22 receives the rounded tip 33 of the plunger 23 and the pawl 12 is in a closed position to block rotation of the latches 10,11 out of interlocking relation with the catches 8,9.

Thus, there has been provided a unique spring biased plunger for frictionally engaging a locking pawl to make sure that the pawl does not become disengaged from an adjacent latch, thereby insuring that the latches and catches will stay locked together, so that the hopper door cannot accidentally drop open. Such a device is especially useful when parts of the hopper door latching mechanism become worn and fit together so loosely that they become susceptible to unlocking.

What is claimed is:

1. A latching mechanism for a railroad car hopper door, comprising:

(a) a pair of catches fixedly secured adjacent the door and extending outwardly therefrom and sandwiching the door therebetween;

(b) a pair of latches carried by the door for interlocking engagement with the catches;

(c) means mounting the latches for unitary rotation into and out of interlocking engagement with the catches;

(d) a pawl carried by the hopper door for interlocking engagement with one of the pair of latches to hold the latches interlocked with the catches;

(e) means mounting the pawl for rotation into and out of interlocking engagement with one of the latches; and (f) a spring biased plunger carried by the hopper door for engaging the pawl when it is interlocked with the latch to aid in the prevention of rotation of the pawl out of interlocking engagement with the latch.

2. The latching mechanism of claim 1, wherein each latch is L-shaped and includes a generally oval-shaped cam with an attached outstanding leg; and the pawl includes a configured tip portion which is rotatable into and out of blocking relation with the rotation of the leg of the adjacent latch, when the latch is in a closed position where the leg thereof is adjacent and parallel the plane of the hopper door.

3. The latching mechanism of claim 2, which includes means for mounting the plunger so that the longitudinal axis thereof is substantially normal to the plane in which the pawl rotates, the plunger designed to intersect the tip portion of the pawl when the pawl is interlocked with the latch.

4. The latching mechanism of claim 3, wherein the pawl includes a curved indentation in the tip portion for receipt of the plunger.

5. The latching mechanism of claim 4, wherein the means for mounting the plunger includes:

(I) a cylindrical collar with a center bore extending from the rotational plane of the pawl;

(II) an annular abutment in the center bore in spaced relation from the rotational plane of the pawl; and the plunger includes:

(III) a cylindrical shank having a pair of opposing ends, one of which protrudes from the bore farthest from the rotational plane of the pawl;

(IV) means adjacent the protruding end of the shank for restricting axial movement of the pawl in the direction of the rotational plane of the pawl;

(V) an enlarged head on the other end of the shank within the center bore, the enlarged head having a conically shaped, rounded tip that extends into the rotational plane of the pawl; and (VI) a coil spring surrounding the shank between the abutment and enlarged head to bias the pawl in the direction of the rotational plane of the pawl.

6. The latching mechanism of claim 5, wherein the tip portion of the pawl includes a curved surface which is formed on a single radius from the rotational axis of the pawl, and the curved indentation is in said curved surface.

7. A latching mechanism for a railroad car hopper door, comprising:

(a) a pair of hook-like catches fixedly secured adjacent the door and extending outwardly therefrom and sandwiching the door therebetween, each of the catches including a recess;

(b) a pair of brackets secured to the hopper door and extending therefrom adjacent the catches;

(c) a pair of latches disposed on the brackets, each of the latches including a generally oval-shaped cam with an outstanding leg;

(d) means for mounting the latches on the brackets for unitary rotation about an axis which parallels the plane of the hopper door, the cams of the latches being rotatable into and out of the recesses of the catches;

(e) a pawl mounted on one of the brackets, the pawl including a tip portion having a curved surface, the points of which are equidistant from the rotational axis of the pawl, the curved surface including a curved indentation formed therein;

(f) means for mounting the pawl on the bracket for rotation in a plane normal to the rotational plane of the adjacent latch, the tip portion of the pawl being rotatable into and out of blocking relation with rotation of the leg of the adjacent latch to and from the hopper door;

(g) a spring biased plunger mounted on the bracket on which the pawl is mounted, for engaging the pawl to hinder rotation of the pawl out of blocking relation with the leg of the adjacent latch, the plunger including a cylindrical shank with a pair of opposing ends one of which has an enlarged head with a conically shaped rounded tip for receipt in the curved indentation of the pawl;

(h) means for mounting the plunger on the bracket for engaging the pawl, including:

(I) a cylindrical collar having a cylindrical bore with a longitudinal axis which is normal to the rotational plane of the pawl, the bore designed to receive the shank and enlarged head of the plunger such that the conically shaped rounded tip of the enlarged head extends from the bore into the rotational plane of the pawl and the other end of the shank, opposite the enlarged head, protrudes from the collar;

(II) an annular abutment extending into the bore in spaced relation from the rotational plane of the pawl; the protruding end of the shank extending from the bore beyond the abutment;

(III) means coacting with the protruding end of the shank adjacent the abutment for restricting axial movement of the plunger in the direction of the rotational plane of the pawl, and (IV) a coil spring surrounding the shank between the abutment and enlarged head to bias the plunger in the direction of the rotational plane of the pawl.

* * * * *